United States Patent [19]

Takagi et al.

[11] Patent Number: 4,609,607

[45] Date of Patent: Sep. 2, 1986

[54] MAGNETIC TONER AND PROCESS FOR PRODUCING THE SAME

[75] Inventors: Seiichi Takagi, Tokyo; Yoshihiko Hyosu, Sagamihara, both of Japan

[73] Assignee: Canon Kabushiki Kaisha, Tokyo, Japan

[21] Appl. No.: 519,415

[22] Filed: Aug. 1, 1983

[30] Foreign Application Priority Data

| | | | |
|---|---|---|---|
| Aug. 6, 1982 | [JP] | Japan | 57-137056 |
| Aug. 6, 1982 | [JP] | Japan | 57-137057 |
| Aug. 6, 1982 | [JP] | Japan | 57-137058 |
| Sep. 27, 1982 | [JP] | Japan | 57-168112 |

[51] Int. Cl.[4] ..... G03G 9/00

[52] U.S. Cl. ..... 430/106.6; 430/109; 430/110; 430/137

[58] Field of Search ..... 430/106.6, 109, 110, 430/137, 903; 524/524, 447

[56] References Cited

U.S. PATENT DOCUMENTS

| | | | |
|---|---|---|---|
| 4,330,460 | 5/1982 | Hoffend et al. | 524/524 |
| 4,360,611 | 11/1982 | Wakimoto et al. | 524/447 |
| 4,407,923 | 10/1983 | Miyakawa et al. | 430/903 |
| 4,415,644 | 11/1983 | Tamaki et al. | 430/109 |
| 4,415,645 | 11/1983 | Kouchi et al. | 430/903 |

*Primary Examiner*—John L. Goodrow

*Attorney, Agent, or Firm*—Fitzpatrick, Cella, Harper & Scinto

[57] ABSTRACT

Spherical toners with magnetic material dispersed internally of the toner particles are obtained by a process for producing toners having the step of suspension polymerization of a dispersion of a toner material containing a magnetic material, a synthetic resin monomer and a polymerization initiator dispersed in a dispersion medium which is substantially incompatible with said monomer.

18 Claims, No Drawings

MAGNETIC TONER AND PROCESS FOR PRODUCING THE SAME

BACKGROUND OF THE INVENTION

1. Field of the Invention

This invention relates to a magnetic toner to be used in electrophotography, electrostatic photography, magnetic recording or electrostatic printing.

2. Description of the Prior Art

Toners (particularly of one-component type) have generally been produced in desired particle sizes by fusion-mixing homogenously with a thermoplastic resin to be homogeneously dispersed therein, and then crushing by a pulverizing device and being classified by a classifying machine. This crushing method is capable of producing considerably excellent toners, but it has certain kinds of restrictions. That is, the toner obtained by use of the crushing method should be made of a material which is brittle to some extent so as to be readily crushed. However, if such a material is too brittle, excessive micropulverization may be caused to such an extent that fine powders must disadvantageously cut in order to obtain toners with an appropriate size distribution, which leads to an increase in cost. Besides, further micropulverization may sometimes occur in a developing vessel in a copying machine. In addition, when a low melting material is used for improvement of the heat fixing characteristic, fusion may occur in a crushing device or a classifying device, whereby continuous production of a toner may be made impossible.

Other necessary conditions for a toner is to have a triboelectrifying characteristic suitable for development, to form an excellent image not to deteriorate in performance on standing, not to cause agglomeration (blocking etc.), to have an appropriate heat or pressure fixing characteristic and to incur no contamination on the surface of a photosensitive material, and so on.

The toner for development of electrostatic charges manufactured by suspension polymerization overcomes the drawbacks of the crushing method. That is, absence of the crushing step requires no brittleness, and the spherical forms obtained give excellent free flowing property and therefore uniform in triboelectrification. Further, by appropriate control of polymerization and by use of a crosslinking agent, there can be obtained a toner excellent in heat fixing characteristic.

In these days, there is a trend of shifting from two-component type toners to one-component type toners, and magnetic toners are most popular among the one-component type toners in practical applications. It is very effective to prepare a magnetic toner by suspension polymerization.

However, when toners containing magnetic materials are to be prepared by suspension polymerization, there sometimes ensue problems in dispersion of the magnetic material. In the crushing method, a binder resin, magnetic powders and additives therefor are kneaded at a high viscosity under a high mechanical shear by a roll mill or a kneader, whereby very good dispersion state can be obtained. However, in case of a polymerization method, a monomer, a magnetic material and others are mixed under a low mechanical shear such as by means of a homomixer, whereby the dispersion is obviously insufficient, resulting in lower image density developed than the one developed by using the toner of the crushing method. To solve such problems, the magnetic material employed must be well dispersed in the synthetic resin monomer used. It should not inhibit the polymerization. If the magnetic powders are excessively fine, they can difficulty be dispersed, giving rise to localization of magnetic powders, whereby the magnetic powders cannot be evenly distributed among the suspended particles at equal proportions, and further the particle size of the toners produced by the suspension polymerization are liable to be distributed broad. Hence, toner properties such as free flowing property, tribo-distribution, image forming characteristics, etc. are considerably worsened. Thus, it is necessary to improve the dispersibility of the magnetic powder. However, the great surface area of magnetic powders requires a large amount of a dispersant to be used, which incurs such unfavorable influences on the toner particles such as decrease in resistance of the toner, etc.

As another disadvantage, when the magnetic powders are too large in size, the number of magnetic powder particles to be incorporated in each suspended particle may become extremely small, with some particles containing substantially no magnetic powder. In such a case, the toner particles formed have magnetic characteristics which greatly vary among particles to result in different developing characteristics of individual toners, leading to lowering in developing performance as a whole.

Further, even when magnetic powders are of certain appropriate sizes, too large specific area of magnetic powders may retard polymerization, lowering the productivity in the end. If an amount of the initiator is increased for removing this drawback, polymer with sufficiently high molecular weight cannot be obtained, which makes it difficult to obtain a toner with appropriate thermal characteristics.

SUMMARY OF THE INVENTION

An object of the present invention is to provide a novel magnetic toner which has overcome the drawbacks possessed by the toner prepared according to such a polymerization process and a process for producing the same.

Another object of the present invention is to provide a magnetic toner excellent in toner characteristics such as developing characteristic and fixing characteristic in such a polymerization process and a process for producing the same.

Still another object of the present invention is to provide a toner in which most of the magnetic material are dispersed, preferably uniformly, internally of the toner particles and a process for producing the same.

Still another object of the present invention is to provide a magnetic toner, in which the magnetic material appearing on the surface of the toner particles comprises 20 wt.% or less (more preferably 10 wt.% or less) of the total magnetic material and a process for producing the same.

Still another object of the present invention is to provide a magnetic toner having a specific resistivity of $10^{11}$ Ω·cm (more preferably $10^{12}$ Ω·cm or more, particularly $10^{13}$ Ω·cm or more) and a process for producing the same.

According to one aspect of the present invention, there is provided a process for producing a magnetic toner, comprising the step of carrying out suspension polymerization of a dispersion of a toner mateiral containing a magnetic material, a synthetic resin monomer and a polymerization initiator dispersed in a dispersion medium which is substantially incompatible with said monomer.

According to another aspect of the present invention, there is provided a process for producing a magnetic toner, comprising the step of carrying out suspension polymerization of a dispersion of a toner material containing a magnetic material having a BET specific area of 10 $m^2/g$ or less and a specific surface area diameter according to the permeability method of 0.1 μm to 2 μm, a synthetic resin monomer and a polymerization initiator dispersed in a dispersion medium which is substantially incompatible with said monomer.

According to a further aspect of the present invention, there is provided a process for producing a magnetic toner, comprising the step of carrying out suspension polymerization of a dispersion of a toner material containing a magnetic material obtained by the sintering method, a synthetic resin monomer and a polymerization initiator dispersed in a dispersion medium which is substantially incompatible with said monomer.

According to a still further aspect of the present invention, there is provided a process for producing a magnetic toner, comprising the step of carrying out suspension polymerization of a dispersion of a toner material containing a magnetic material subjected to a grafting treatment, a synthetic resin monomer and a polymerization initiator dispersed in a dispersion medium which is substantially incompatible with said monomer.

According to a still further aspect of the present invention, there is provided a process for producing a magnetic toner, comprising the step of carrying out suspension polymerization of a dispersion of a toner material containing a fatty acid metal soap, an oxidized wax or a metal salt wax, a magnetic material, a synthetic resin monomer and a polymerization initiator dispersed in a dispersion medium which is substantially incompatible with said monomer.

According to a still further aspect of the present invention, there is provided a magnetic toner obtained by suspension polymerization of a dispersion of a toner material containing a magnetic material, a synthetic resin monomer and a polymerization initiator dispersed in a dispersion medium which is substantially incompatible with said monomer.

DESCRIPTION OF PREFERRED EMBODIMENTS

The magnetic material to be used in the present invention may be a substance which can be strongly magnetized by a magnetic field. Preferably, magnetite may be used.

Typical magnetic or magnetizable materials may include metals such as cobalt, iron, nickel, etc.; alloys of metals such as aluminum, cobalt, steel, lead, magnesium, nickel, tin, zinc, antimony, beryllium, bismuth, cadmium, calcium, manganese, selenium, titanium, tungsten, vanadium, etc. and mixtures thereof; metal oxides such as aluminum oxide, iron oxide, copper oxide, nickel oxide, zinc oxide, titanium oxide and magnesium oxide; refractory nitrides such as vanadium nitride, chromium nitride, etc.; carbides such as tungsten carbide; ferrites and mixtures thereof.

A magnetic material having a BET specific surface area of 10 $m^2/g$ or less and a specific surface area diameter by the permeability method of 0.1 μm to 2 μm, a magnetic material subjected to the grafting treatment, or a magnetic material obtained by the sintering method has good wettability with a monomer and therefore can be dispersed uniformly therein. If a magnetic material is not sufficiently wettable with the monomer when a monomer system (toner material) is dispersed in a dispersion medium, the magnetic material is liable to gather together at the interface between the monomer and the dispersing medium. However, no such phenomenon is observed in the present invention due to good wettability of the magnetic material with the monomer.

The magnetic toner obtained by sintering appears to have the improved wettability with the monomers because of the decreased sulfate radical on the surface of the magnetic material, as compared with the magnetic material before sintering.

The magnetic powders by the sintering method to be used in the present invention can be obtained by sintering the above-described magnetic powders. Preferably, magnetite may be employed, and a sintered magnetite $Fe_3O_4$ can be obtained by sintering magnetite $Fe_3O_4$ at around 1000° C., and then reducing the resultant hematite $Fe_2O_3$.

For grafting the magnetic material to be used in the present invention, there may be employed the methods as described below, to which the present invention is not limited. For example, a polymerization initiator is dissolved or dispersed in a mixture of either a silane coupling agent having a vinyl group or a titanium coupling agent having a vinyl group with a monomer. To this mixture is added the aforesaid magnetic material (or the sintered magnetic material) and is thoroughly mixed at a normal temperature until homogeneously mixed, followed by temperature elevation. Both the reaction of the silane coupling agent or the titanium coupling agent with the magnetic material and copolymerization of the vinyl groups of the coupling agent and the monomer will occur to effect stable grafting.

The weight ratio of the vinyl monomer to the silane- or titanium coupling agent having a vinyl group may be in the range of from 95:5 to 5:95 by weight basis.

As the silane coupling agent, there may be employed vinyl trichlorosilane, vinyl triethoxysilane, vinyl-tris-(β-methoxyethoxy)-silane and the like, and a titanium coupling agent may be exemplified by isopropyl triacryl titanate, etc.

In another example of the method, grafting may be conducted as follows. That is, 1 to 4 g of α,α'-azobisisobutyronitrile is dissolved in 100 g of styrene at a room temperature. To this solution is added 200 g of a magnetic material (BL-200) and the mixture is sufficiently stirred by a high speed stirring means such as a blender mill so that styrene and the polymerization initiator may cover uniformly the surfaces of the magnetic material. Then, the mixture is transferred into a flask equipped with a condenser and a stirrer, followed by polymerization under stirring at 70° C. for 5 to 6 hours. The degree of grafting is measured using 1 g of the sample of the product. 50 ml of chloroform is added thereto, and filtered by means of a glass filter. Then, it is washed with chloroform 4 or 5 times until no resin is eluted in the filtrate. Then, after being dried sufficiently in a vacuum drier, the grafted polymer is quantitatively determined. In this example, from the carbon % by elemental analysis, the quantity of the graft polymer is found to be 3.8 wt. %. The monomer to be grafted may be as a general rule of the same kind as the main monomer in the suspension polymerization, to which, however, the present invention is not limited. The polymerization initiator used in the grafting is not also limited to azo type, but a peroxide type initiator may also be used.

The advantage of the use of a graft-treated magnetic material is that it can be easily dispersed in a monomer and the dispersion is stable, which readily polymerizes to give jet-black particles. Also, by treatment of a magnetic material which is liable to inhibit polymerization, the inhibition of polymerization of the monomer can be reduced, whereby polymerization to a high molecular weight polymer can be completed easily within a short time.

The degree of grafting may be 0.1 wt. % to 10 wt. % to exhibit an appreciable effect, more preferably 0.5 wt. % to 10 wt. %. Although no adverse effect on the toner characteristics is observed at a level of higher than 10 wt. %, such a high level is unnecessary, since the prolonged time is required for blending other toner ingredient due to the high viscosity.

Also, by incorporation of a fatty acid metal soap, an oxidized wax or a metal salt wax into a monomer system, wettability of the magnetic material with a monomer can be improved to give a uniform dispersion. If a magnetic material is not sufficiently wettable with a monomer when a monomer system (toner material) is dispersed in a dispersion medium, the magnetic material is prone to gather at the interface between the monomer system and the dispersion medium. However, no such phenomenon occurs in the present invention due to good wettability of the magnetic material with the monomer.

The fatty acid for a metal soap used in the present invention is a substance represented by RCOOH, as exemplified by caproic acid, enanthic acid, caprylic acid, pelargonic acid, capric acid, undecylenic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, lacceric acid, oleic acid, stearolic acid, arachidonic acid, and the like.

Accordingly, the fatty acid metal soap to be used in the present invention includes various higher fatty acid salts of metals represented by M(OOCR)n, such as cadmium stearate, cadmium naphthenate, barium stearate, barium laurate, calcium stearate, zinc stearate, zinc laurate, aluminum stearate, magnesium stearate and the like.

The oxidized wax, the metal salt wax in this invention means an oxidized petrolatum with an acid value (mg KOH/g) of 8 or higher and calcium or barium salt thereof. They may be added in amounts of 0.2 to 10 parts by weight, preferably 0.5 to 5 parts by weight per 100 parts by weight of the magnetic material.

In the present invention, the magnetic material is mostly dispersed within the toner particles, and the state of such a dispersion can be confirmed by the method as shown below.

The one method is observation of the toner surfaces by means of a scanning electron microscope. The magnetic toner particles in which the magnetic material is not homogeneously dispersed have uneven surfaces with projections and recesses, and some portion of the magnetic particles appears at the surfaces. For example, when observed with a magnification of $\times 10{,}000$, the magnetic particles appear at the surface can be confirmed. In contrast, in a magnetic toner with good dispersion, the toner surfaces have less unevenness or they are smooth, and no or very few, if any, magnetic particles can be observed to be exposed on the toner surfaces by the 10,000-magnification observation.

Another method is judgement by specific resistance. A certain quantity of the toner is taken, and is pressed under a certain load into a pellet. This pellet is placed between electrode plates and a direct current voltage is applied thereon, and the specific resistance is determined from the current value and the applied voltage. The magnetic material itself has a specific resistance of not more than $10^9$ Ω·cm, and a magnetic toner with the magnetic material exposed on the surfaces exhibits a specific resistance of $10^{10}$ Ω·cm or less. In contrast, a magnetic toner with good dispersion of a magnetic material exhibits a specific resistivity of $10^{11}$ Ω·cm or higher.

As the synthetic resin monomers, there may be included, for example, styrene and derivatives thereof such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, p-n-dodecylstyrene and the like; unsaturated monoolefins such as ethylene, propylene, butylene, isobutylene and the like; vinyl halides such as vinyl chloride, vinylidene chloride, vinyl bromide, vinyl fluoride and the like; vinyl esters such as vinyl acetate, vinyl propionate, vinyl benzoate and the like; α-methylene aliphatic mono-carboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate and the like; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate and the like; vinyl ethers such as vinyl methyl ether, vinyl ethyl ether, vinyl isobutyl ether and the like; vinyl ketones such as vinyl methyl ketone, vinyl hexyl ketone, vinyl isopropenyl ketone and the like; N-vinyl compounds such as N-vinylpyrrole, N-vinylcarbazole, N-vinylindole, N-vinylpyrrolidone and the like; vinylnaphthalenes; acrylic acid or methacrylic acid derivatives such as acrylonitrile, methacrylonitrile, acrylamide, etc.; and so on.

In the present invention, the polymer may be crosslinked by a crosslinking agent. For example, there may be employed suitably crosslinking agents in general, including divinylbenzene, divinylnaphthalene, divinyl ether, divinyl sulfone, diethyleneglycol dimethacrylate, triethyleneglycol dimethacrylate, ethyleneglycol dimethacrylate, polyethyleneglycol dimethacrylate, diethyleneglycol dimethacrylate, triethyleneglycol diacrylate, 1,3-butyleneglycol dimethacrylate, 1,6-hexaneglycol dimethacrylate, neopentylglycol dimethacrylate, dipropyleneglycol dimethacrylate, polypropyleneglycol dimethacrylate, 2,2'-bis-(4-methacryloxy-diethoxyphenyl)-propane, 2,2'-bis-(4-acryloxydiethoxyphenyl)-propane, trimethlolpropane trimethacrylate, trimethlolpropane triacrylate, tetramethylolmethane tetraacrylate, dibromoneopentylglycol dimethacrylate, diallyl phthalate, and others.

When these crosslinking agents are used in an excessive amount, the resultant toner becomes infusible to give poor fixing characteristic. When the amount used is too small, the toner may be unsatisfactory in blocking characteristic, durability, etc. which are necessary characteristics for a toner, and it is difficult to prevent the so called off-set phenomenon, in which a part of the toner does not completely stick onto a paper in the hot roll fixing, but adheres on the roller surface and transfers to the subsequently coming paper. Therefore, these cross-linking agents may be employed in amounts of 0.001 to 15 wt. %, more preferably 0.1 to 10 wt. %, based on the total amount of the monomer.

As the polymerization initiator, there may be employed any polymerization initiators, such as azobisisobutyronitrile (AIBN), benzoyl peroxide, methyl ethyl ketone peroxide, isopropylperoxy carbonate, cumene hydroperoxide, 2,4-dichlorobenzoyl peroxide, lauroyl peroxide, etc., for the polymerization of a monomer. In general, it may be used sufficiently in an amount of 0.1 to 10 wt. %, more preferably 0.5 to 5 wt. % based on the total amount of the monomer.

The dispersion medium in this invention may be aqueous. To the dispersion medium to be used in the present invention, there may be added a suitable stabilizer, such as polyvinyl alcohol, gelatin, methyl cellulose, methylhydroxypropyl cellulose, ethyl cellulose, sodium salt of carboxymethyl cellulose, polyacrylic acid and salts thereof, tricalcium phosphate, talc, barium sulfate, bentonite, aluminum hydroxide, ferric hydroxide, titanium hydroxide, etc., which may be included in an aqueous phase. Such a stabilizer may be used in an amount stabilized in a continuous phase, preferably within the range of about 0.1 to 10 wt. %.

For effecting minute dispersion by the aforesaid inorganic dispersant, it is also preferable to use a surfactant within the range of 0.01 to 0.1 wt. %. This is added for promoting the desired action of the above dispersion stabilizer, and typical examples may include sodium dodecylbenzenesulfonate, sodium tetradecylsulfate, sodium pentadecylsulfate, sodium octylsulfate, sodium allyl-alkyl-polyethersulfonate, sodium oleate, sodium laurate, sodium caprate, sodium caprylate, sodium caproate, potassium stearate, calcium oleate, sodium 3,3'-disulfodiphenylurea-4,4'-diazo-bis-amino-8-naphthol-6-sulfonate, o-carboxybenzene-azo-dimethylaniline, sodium 2,2',5,5'-tetramethyl-triphenylmethane-4,4'-diazo-bis-$\beta$-naphthol-disulfonate and others.

It is also preferable to prevent emulsion polymerization by adding a water soluble polymerization inhibitor such as a metal salt, because a monomer readily soluble in water may cause emulsion polymerization in water at the same time thereby to contaminate the suspension polymerized product with small emulsion polymerized particles. Addition of glycerine or glycol is also preferred for preventing integration of particles by increasing the viscosity of the medium. Also, for the purpose of reducing the solubility of a readily soluble monomer in water, salts such as NaCl, KCl, $Na_2SO_4$ may also be employed.

The suspending method in this invention comprises dispersing a monomer system having a polymerization initiator, a magnetic material, a monomer and additives homogeneously dissolved or dispersed therein in an aqueous phase, namely a continuous phase, containing a suspension stabilizer by means of a conventional stirrer or a Homo Mixer, homogenizer, etc. Preferably, the stirring speed and time may be initially controlled so that the monomer droplets may have the desired sizes of toner particles, generally 30$\mu$ or less, and thereafter stirring may be conducted to the extent to prevent sedimentation of the particles so that the established state may be maintained through the action of the dispersion stabilizer. The polymerization temperature may be set at 50° C. or higher, generally 70° C. to 90° C. After completion of the polymerization, the toner particles formed are washed, recovered by a suitable method such as filtration, decantation, centrifugation, etc. and dried.

EXAMPLE 1

In a vessel equipped with a high shearing force mixing device such as TK-Homo Mixer (produced by Tokushu Kygyo Co.) were homogeneously mixed for about 20 minutes 400 g of styrene, 240 g of EPT-1000 magnetite having a specific surface area diameter by permeability method of 0.4$\mu$ as measured by Sizer (a particle size distribution apparatus by air permeation, supplied by Fisher Co.) and a BET specific surface area of 6.0 $m^2/g$ and 8 g of acetylsalicylic acid chromium complex. During this operation, the temperature was elevated to about 50° C. Within this period of time, the above magnetite was found to be dispersed in the styrene monomer. Into the above styrene monomer containing magnetite was mixed 30 g of lauroyl peroxide. While maintaining an aqueous solution having dissolved 9.0 g of polyvinyl alcohol in 600 g of water at 70° C., the above slurry was poured thereinto, followed by stirring at 4000 rpm for 30 minutes. This reaction mixture was stirred by means of a paddle blade to complete polymerization. After washing with water, filtration and drying, there was obtained a toner having a specific resistance of $10^{13}$ $\Omega$·cm with a number average diameter of 12.7$\mu$ (100$\mu$ aperture, by electric zone method using Coulter Counter supplied by Coulter Co.). It was also found to have a Tg of 70° C. as measured by DSC. By using this toner, image formation was performed by means of a commercially available dry system electrophotographic copying machine NP-200 J (manufactured by Canon K.K.). As the result, there could be obtained a clear image without fog. The image density of 1.0 was obtained by a reflective densitometer at the solid black portion. Further, the toner characteristics were also found to be satisfactory, being especially excellent in free flowing property, continuous image forming durability and fixing characteristic.

EXAMPLE 2

According to the same procedure as in Example 1, by use of 320 g of styrene, 80 g of methyl methacrylate and a magnetite having a specific surface area diameter of 0.2$\mu$ and a BET specific area of 6.5 $m^2/g$, there was obtained a toner having a specific resistance of $5\times10^{13}$ $\Omega$·cm and a number average diameter of 12.7$\mu$ (using Coulter Counter, 100$\mu$ aperture). This toner was formed into an image by a commercially available dry system copying machine NP-200 J. As the result, a clear image without fog was obtained. The image density obtained was 1.05 at the solid dark portion by a reflective densitometer.

EXAMPLE 3

In a ball mill were homogeneously dispersed and mixed 80 g of styrene, 20 g of n-butyl methacrylate, 0.2 g of trimethylolpropane triacrylate, 60 g of a magnetite having a specific surface area diameter of 0.25$\mu$ and a BET specific surface area of 5.8 $m^2/g$ and 2 g of acetylsalicylic acid-chromium complex. Then, 3 g of 2,2'-azobis-(2,4-dimethylvaleronitrile) was added to and dissolved in the resultant dispersion. The above slurry was added to an aqueous phase comprising 300 g of water containing 3 g of tricalcium phsphate and 0.05 g of sodium dodecylbenzenesulfornate, while under stirring at 5000 rpm by means of TK-homogenizer. Polymerization was completed after being carried out at 60° C. for 7 hours. After cooling, the mixture was filtered and dried to give a toner having a specific resistance of $7\times10^{13}$ Ω·cm and a number average diameter of 10μ (Coulter Counter, 100μ aperture). This toner was formed into an image by means of a commercially available dry system electrophotographic copying machine NP-200J. As the result, a clear image without fog could be obtained.

EXAMPLE 4

In a vessel equipped with a high shearing force mixing device such as TK-Homo Mixer (produced by Tokushu Kogyo Co.) were homogeneously mixed for about 20 minutes 400 g of styrene, 240 g of a sintered magnetite having a specific surface area diameter of 1.65μ and a BET specific surface area of 2.1 $m^2/g$ and 8 g of acetylsalicylic acid-chromium complex. During this operation, the temperature was elevated to about 50° C. Within this period of time, the above magnetite was found to be dispersed in the styrene monomer. Into the above magnetite containing styrene monomer was stirred 30 g of lauroyl peroxide. While maintaining an aqueous solution having dissolved 9.0 g of polyvinyl alcohol in 600 g of water at 70° C., the above slurry was added thereto, followed by stirring at 4000 rpm for 30 minutes. This reaction mixture system was stirred by means of a paddle blade to complete polymerization. After washing with water, filtration and drying, there was obtained a toner having a specific resistance of $4\times10^{13}$ Ω·cm and a number average diameter of 15μ. This toner was formed into images by means of a commercially available dry system electrophotographic copying machine NP-200 J. As the result, there could be obtained a clear image without fog. The image density of 0.96 was obtained by a reflective densitometer at the solid black portion. Further, the toner characteristics were also found to be satisfactory, being especially excellent in free flowing property and continuous image forming durability.

EXAMPLE 5

According to the same procedure as in Example 4, by use of 320 g of styrene, 80 g of methyl methacrylate and a sintered magnetite having a specific surface area size of 1.5μ and a BET specific area of 2.5 $m^2/g$, there was obtained a toner having a specific resistance of $2\times10^{14}$ Ω·cm and a number average diameter of 12.3μ (using Coulter Counter, 100μ aperture). This toner was formed into an image by a commercially available dry system copying machine NP-400RE. As the result, a clear image without fog was obtained. The image density obtained was 1.2 at the solid dark portion by a reflective densitometer.

EXAMPLE 6

In a ball mill were homogeneously dispersed and mixed 80 g of styrene, 20 g of n-butyl methacrylate, 0.2 g of trimethylolpropane triacrylate, 60 g of a sintered magnetite having a specific surface area diameter of 0.15μ and a BET specific surface area of 6 $m^2/g$ and 2 g of acetylsalicylic acid-chromium complex. Then, 3 g of 2,2'-azobis-(2,4-dimethylvaleronitrile) was added to and dissolved in the resultant dispersion. The above slurry was added to an aqueous phase comprising 300 g of water containing 3 g of tricalcium phosphate and 0.05 g of sodium dodecylbenzenesulfonate, while under stirring at a speed of 5000 rpm by means of TK-homogenizer. Polymerization was completed after being carried out at 60° C. for 7 hours. After cooling, the mixture was filtered and dried to give a toner having a specific resistance of $3\times10^{14}$ Ω·cm and a number average diameter size of 9.6μ (using Coulter Counter, 100μ aperture). This toner was formed into an image by means of a commercially available dry system electrophotographic copying machine NP-400RE. As the result, a clear image without fog could be obtained.

EXAMPLE 7

240 g of a magnetic material EPT-1000, (specific surface area diameter: 0.4μ, BET specific area: 6.0 $m^2/g$) was grafted with a mixture of styrene and vinylethoxysilane. The amount grafted was 3.5 wt. %.

To this product were added 400 g of styrene and 8 g of acetylsalicylic acid-chromium complex and the mixture was homogeneously mixed in a vessel equipped with a high shearing force mixing device such as TK-homomixer (produced by Tokushu Kogyo Co.). During this operation, the temperature was elevated to about 50° C. Within this period of time, the above magnetite was found to be dispersed in the styrene monomer.

To the above magnetite containing styrene monomer was mixed 30 g of lauroyl peroxide. While maintaining an aqueous solution having dissolved 9.0 g of polyvinyl alcohol in 600 g of water at 70° C., the above slurry was added to it, followed by stirring at 4000 rpm for 30 minutes to obtain particles of about 10μ. This reaction mixture was stirred by means of a paddle blade to complete polymerization. After washing with water, filtration and drying, there was obtained a toner having a specific resistance of $8\times10^{15}$ Ω·cm with a number average diameter of 9.6μ (using Coulter Counter, 100μ aperture). This toner was formed into an image by means of a commercially available dry system electrophotographic copying machine NP-400 RE. As the result, there could be obtained a clear image without fog. The image density of 1.3 was obtained by a reflective densitometer at the solid black portion. Further, the toner characteristics were also found to be satisfactory, being especially excellent in free flowing property and continuous image forming durability.

EXAMPLE 8

240 g of a magnetic material (specific surface area diameter: 0.2μ, BET specific area: 6.5 $m^2/g$) was grafted with ethyl methacrylate. The amount grafted was 3.8 wt. %.

By use of this grafted product, 320 g of styrene and 80 g of ethyl methacrylate, according to the same procedure as in Example 7, there was obtained a toner having a specific resistance of $9\times10^{15}$ Ω·cm and a number average size of 9.4μ (using Coulter Counter, 100μ aperture).

This toner was formed into an image by means of a commercially available dry system electrophotographic copying machine NP-400 RE. As the result, there could be obtained a clear image without fog. The image density of 1.25 was obtained by a reflective densitometer at the solid black portion.

EXAMPLE 9

60 g of magnetite (specific surface area diameter: 0.25μ, BET specific area: 5.8 $m^2/g$) was grafted with n-butyl methacrylate. The amount grafted was 3.8 wt %.

To this product were added 80 g of styrene, 20 g of n-butyl methacrylate, 0.2 g of trimethylolpropane triacrylate and 2 g of acetylsalicylic acid-chromium complex, followed by homogeneous dispersing and mixing in a ball mill.

Then, 3 g of 2,2'-azobis-(2,4-dimethylvaleronitrile) was added to and dissolved in the resultant dispersion. The above slurry was added to an aqueous phase comprising 300 g of water containing 3 g of tricalcium phsphate and 0.05 g of sodium dodecylbenzenesulfonate, while under stirring at 5000 rpm by means of TK-homogenizer. Polymerization was completed after being carried out at 60° C. for 7 hours. After cooling, the mixture was filtered and dried to give a toner having a specific resistance of $5\times10^{15}$ Ω·cm and a number average diameter of 8.9μ (using Coulter Counter, 100μ aperture). This toner was formed into an image by means of a commercially available dry system electrophotographic copying machine NP-400 RE. As the result, a clear image without fog could be obtained.

EXAMPLE 10

In a vessel equipped with a high shearing force mixing device such as TK-homomixer (produced by Tokushu Kogyo Co.) were homogeneously mixed for about 20 minutes 400 g of styrene, 240 g of EPT-1000 magnetite having a specific surface area diameter of 0.4μ and a BET specific surface area of 6.0 $m^2/g$, 24 g of OX-0851 (oxidized petrolatum metal salt, produced by Nippon Seiro Co.) and 8 g of acetylsalicylic acid-chromium complex. During this operation, the temperature was elevated to about 50° C. Within this period of time, the above magnetite was found to be dispersed in the styrene monomer.

Into the above magnetite containing styrene monomer was mixed 30 g of lauroyl peroxide.

While maintaining an aqueous solution having dissolved 9.0 g of polyvinyl alcohol in 600 g of water at 70° C., the above slurry was added to it, followed by stirring at 4000 rpm for 30 minutes. This reaction mixture system was stirred by means of a paddle blade to complete polymerization. After washing with water, filtration and drying, there was obtained a toner having a specific resistance of $6\times10^{15}$ Ω·cm with a number average diameter of 10.11μ, and with 15% in the number distribution being not less than 6.35μ, and 1% in the volume distribution being not less than 20.2μ (using Coulter Counter, 100μ aperture).

By using this toner, image formation was performed by means of a commercially available dry system electrophotographic copying machine NP-400 RE. As the result, there could be obtained a clear image without fog. The image density of 1.20 was obtained by a reflective densitometer at the solid black portion. Further, the toner characteristics were also found to be satisfactory, being especially excellent in free flowing property, and continuous image forming durability.

EXAMPLE 11

According to the same procedure as in Example 10, by use of 320 g of styrene, 80 g of ethyl methacrylate and a magnetite having a specific surface area diameter of 0.2μ and a BET specific area of 6.5 $m^2/g$, there was obtained a toner having a specific resistance of $9\times10^{15}$ Ω·cm and a number average size of 10.5μ (using Coulter Counter, 100μ aperture). This toner was formed into an image by a commercially available dry system copying machine NP-400 RE. As the result, a clear image without fog was obtained. The image density obtained was 1.0 at the solid dark portion by a reflective densitometer.

EXAMPLE 12

In a ball mill were homogeneously dispersed and mixed 80 g of styrene, 20 g of n-butyl methacrylate, 0.2 g of trimethylolpropane triacrylate, 60 g of a magnetite having a specific surface area diameter of 0.25μ and a BET specific surface area of 5.8 $m^2/g$, 9 g of acetylsalicylic acid-chromium complex and 3 g of stearic acid. Then, 3 g of 2,2'-azobis-(2,4-dimethylvaleronitrile) was added to and dissolved in the resultant dispersion. The above slurry was added to an aqueous phase comprising 300 g of water containing 3 g of tricalcium phosphate and 0.05 g of sodium dodecylbenzenesulfonate, while under stirring at 5000 rpm by means of TK-homogenizer. Polymerization was completed after being carried out at 60° C. for 7 hours. After cooling, the mixture was filtered and dried to give a toner having a specific resistivity of $3\times10^{15}$ Ω·cm and a number average size of 9.2μ (using Coulter Counter, 100μ aperture). This toner was formed into an image by means of a commercially available dry system electrophotographic copying machine NP-400 RE. As the result, a clear image without fog could be obtained.

What we claim is:

1. A process for producing magnetic toner particles having a specific resistance of $10^{11}$ ohm·cm or more, comprising the steps of:
   (a) dispersing a monomer system having a synthetic resin monomer, a polymerization initiator and a magnetic material in an aqueous dispersion medium to obtain droplets of the monomer system, said magnetic material being obtained by sintering and having a BET specific area of 10 $m^2/g$ or less and a specific surface area diameter by permeability method of 0.1 μm to 2 μm; and
   (b) carrying out suspension polymerization of the droplets to obtain said magnetic toner particles having the magnetic material dispersed primarily within said magnetic toner particles.

2. A process according to claim 1, wherein the toner particles have a specific resistance of $10^{12}$ ohm·cm or more.

3. A process according to claim 1, wherein the magnetic material is magnetite.

4. A process for producing magnetic toner particles having a specific resistance of $10^{11}$ ohm·cm or more, comprising the steps of:
   (a) dispersing a monomer system having a synthetic resin monomer, a polymerization initiator and a graft-treated magnetic material in an aqueous dispersion medium to obtain droplets of the monomer system; and
   (b) carrying out suspension polymerization of the droplets to obtain said magnetic toner particles having the graft-treated magnetic material dispersed primarily within said magnetic toner particles.

5. A process according to claim 4, wherein the grafting treatment is conducted with the use of a vinyl monomer.

6. A process according to claim 4, wherein the grafting treatment is conducted with the use of a mixture of a vinyl monomer and a silane coupling agent having a vinyl group.

7. A process according to claim 4, wherein the grafting treatment is conducted with the use of a mixture of a vinyl monomer and a titanium coupling agent having a vinyl group.

8. A process according to claim 4, wherein the graft-treated magnetic material is prepared by graft-treating a magnetic material having a BET surface area of 10 $m^2/g$ or less and a specific surface area diameter of 0.1 $\mu m$ to 2 $\mu m$.

9. A process according to claim 8, wherein the magnetic material is obtained by the sintering method.

10. A process according to claim 8, wherein the magnetic material is magnetite.

11. A process according to claim 4, wherein the toner has a specific resistance of $10^{12}$ ohm·cm or more.

12. A process for producing magnetic toner particles having a specific resistance of $10^{11}$ ohm·cm or more, comprising the steps of:

(a) dispersing a monomer system having a synthetic resin monomer, a polymerization initiator, a magnetic material and a fatty acid metal soap, an oxidized wax or a metal salt wax in an aqueous dispersion medium to obtain droplets of the monomer system, said magnetic material having a BET specific area of 10 $m^2/g$ or less and a specific surface area diameter by permeability method of 0.1 $\mu m$ to 2 $\mu m$; and (b) carrying out suspension polymerization of the droplets to obtain said magnetic toner particles having the magnetic material dispersed primarily within the magnetic toner particle.

13. A process according to claim 12, wherein the magnetic material is obtained by the sintering method.

14. A process according to claim 12, wherein the fatty acid metal soap, the oxidized wax or the metal salt wax is added in the monomer system in amounts of 0.2 to 10 parts by weight per 100 parts by weight of the magnetic material.

15. A magnetic toner having a specific resistance of $10^{11}$ ohm·cm or more, comprising a polymer and a graft-treated magnetic material dispersed primarily within said polymer, said magnetic toner being obtained by:

(a) dispersing a monomer system having a synthetic resin monomer, a polymerization initiator and a graft-treated magnetic material in an aqueous dispersion medium to obtain droplets of the monomer system; and (b) carrying out suspension polymerization of the droplets to obtain said magnetic toner of particles having the graft-treated magnetic material dispersed primarily within the magnetic toner particles.

16. A magnetic toner according to claim 15, wherein the grafting treatment is conducted with the use of a vinyl monomer.

17. A magnetic toner according to claim 15, wherein the grafting treatment is conducted with the use of a mixture of a vinyl monomer and a silane coupling agent having a vinyl group.

18. A magnetic toner according to claim 15, wherein the grafting treatment is conducted with the use of a mixture of a vinyl monomer and a titanium coupling agent having a vinyl group.

* * * * *